US005626804A

United States Patent [19]

Benkowski et al.

[11] Patent Number: 5,626,804

[45] Date of Patent: May 6, 1997

[54] ROLLER POSITION CONTROLLER FOR A CONTINUOUS BELT PRESS

[75] Inventors: Frank J. Benkowski, New Philadelphia, Ohio; Eric S. DelliGatti, Clifton, N.Y.; David A. Kadri, West Lafayette, Ohio

[73] Assignee: General Electric Company, Coschocton, Ohio

[21] Appl. No.: 562,312

[22] Filed: Nov. 22, 1995

Related U.S. Application Data

[62] Division of Ser. No. 84,694, Jun. 29, 1993, abandoned.

[51] Int. Cl.[6] ..... B30B 5/06; B30B 15/26

[52] U.S. Cl. ..... 264/40.5; 100/151; 250/227.21; 264/166; 425/150; 425/371

[58] Field of Search ..... 250/227.21, 231.14, 250/227.28; 264/408, 409, 410, 412, 40.7, 40.5, 319, 320, 166; 425/135, 138, 150, 168, 371, 372, 363; 100/157

[56] References Cited

U.S. PATENT DOCUMENTS

| | | | |
|---|---|---|---|
| 3,354,319 | 11/1967 | Loewen et al. | 250/227.21 |
| 3,461,304 | 8/1969 | Genhar et al. | 250/227.21 |
| 4,096,383 | 6/1978 | Mancini et al. | 250/231.14 |
| 4,457,683 | 7/1984 | Gerhardt et al. | 425/373 |
| 4,536,649 | 8/1985 | Kozai et al. | 250/231.14 |
| 4,613,293 | 9/1986 | Gerhardt | 425/371 |
| 4,621,999 | 11/1986 | Gerhardt | 425/371 |
| 4,726,871 | 2/1988 | Hüsges et al. | 156/389 |
| 4,767,164 | 8/1988 | Yeung | 250/227.21 |
| 4,870,270 | 9/1989 | Brennan | 250/227.21 |
| 4,923,384 | 5/1990 | Gerhardt | 425/371 |
| 4,966,642 | 10/1990 | Zitzmann | 156/164 |
| 5,038,031 | 8/1991 | Kurosawa et al. | 250/227.28 |
| 5,193,451 | 3/1993 | Sitzler et al. | 425/371 |

FOREIGN PATENT DOCUMENTS

| | | | |
|---|---|---|---|
| 3940579 | 6/1991 | Germany | 425/371 |

OTHER PUBLICATIONS

Siempelkamp, *Siempelkamp Contiroll for Technical Laminates*, pp. 1–5, date unknown.

Gre Con, *Hydro–Dyn Double Belt Presses*, pp. 1–3, Oct. 31, 1985.

Hymmen, *The best way to produce decorative laminates in sheet or roll form*, pp. 1–2, date unknown.

*Primary Examiner*—Mathieu D. Vargot

[57] ABSTRACT

The present invention provides a roller position controller for a continuous belt press whereby the positions of the rollers supporting the belts are monitored and controlled, so that their relative positions always remain staggered and fixed with respect to each other. By maintaining the rollers in a synchronized relationship, material defects such as "pinching" are avoided.

15 Claims, 9 Drawing Sheets

ROLLER POSITION CONTROLLER FOR A CONTINUOUS BELT PRESS

This is a continuation of Ser. No. 08/084,694 filed on Jun. 29, 1993, now abandoned.

BACKGROUND OF THE INVENTION

Belt-type presses for making particleboard, fiberboard, copper clad boards for printed circuit boards and the like are known in the prior art related to the invention. The materials being pressed (known as press materials or press products) can include laminates, rubber products, particleboard, plastics and any other products formed by pressing multiple layers together. Generally, belt presses comprise an endless upper press belt, often a steel press belt, circulated over spaced-apart guide belt rollers, and a corresponding endless lower press belt, also often a steel press belt, circulated over spaced-apart guide belt rollers as well. Between them, these press belts form a pressing gap or pressing region of the belt-type press, between the press framework having upper and lower platens. The upper and lower belts each have their own drive mechanisms. In a known press of this type, two chains are associated with each of the press platens and press belts, or a total of four chains per belt press system. The upper and lower platens form an entrance region along a complete horizontal plane.

Into the pressing region between the platens and their corresponding press belts, the spaced apart rollers are fed and guided along a circulation path with the aid of upper and lower roller circulation mechanisms. The roller circulation mechanisms comprise upper and lower chain sets, where each set is driven by a chain drive sprocket. The chain sets, in turn, circulate or drive the rollers so that the rollers move along with the press belts, situated between their respective belts and the platens. Guide rails are used to channel the movement of the chain sets and rollers in the intended direction. Thus, the upper press mechanism has two chains with rollers disposed across the width of the press between both chains, and the lower press mechanism has two corresponding chains with rollers disposed between them as well.

In many cases, the upper and lower platens are heated. The rollers are situated between the steel press belts and the heated platens. The rollers are equally spaced apart and roll more or less along with the belt. As press material is inserted into the entrance of the pressing region (or press gap entrance), the steel press belts are contacted by the press products on one side and the rollers on the other. In turn, the rollers contact the press belts and the heated platens, thus acting to transfer heat from the platens to the steel belts. The heat is ultimately transferred from the platen to the steel press belt via the rollers. Finally, the heat is transferred from the steel press belt to the press material.

For the circulation of rolling rods to the press gap entrance, the rolling rods are channeled along guide rails and links cooperating with sliding wheels and guide wheels. Both sets of chains, that is, the upper and lower chain sets, are driven individually by chain drive motors. Each motor is connected to a chain drive axis, which has chain drive sprockets disposed at its ends. The upper and lower chain drive systems, however, are not connected mechanically because the belt press is specifically designed to open. That is, the upper and lower belt press mechanisms form a "C", with the upper belt press as the top half of the "C", and the lower belt press as the bottom half. In this manner, the belt press system can easily be maintained, and all moving parts are freely accessible to the operator or maintenance personnel.

Since the upper and lower roller chain drive mechanisms are not mechanically connected, problems result when the relative positions of the upper and lower chain/roller mechanisms cannot be accurately synchronized. That is, the rollers may travel at different speeds, resulting in a condition where the upper and lower roller sets occasionally overlap. In normal operation, the upper and lower roller sets are equally spaced apart and staggered from top to bottom so that either an upper or lower roller is aligned with and reach the press gap entrance at a time, but never both simultaneously. For example, when an upper press roller is at the press gap entrance, a space between two rollers of the lower press should be aligned at that same point. In this manner, only one roller (either an upper or lower roller) is contacting its press belt at the press gap entrance at a time. However, in the absence of any mechanism to keep the upper and lower roller chains synchronized, the upper and lower roller chains "drift" with respect to each other, and the upper and lower rollers eventually overlap at the press gap entrance. That is, an upper roller and lower roller can reach the press gap entrance at exactly the same moment. When this occurs, the press material is "pinched" between the two rollers, and a press material defect known as a bar mark occurs. Bar marks are the result of the roller overlap at the press gap entrance, and are created by high localized pressure loading. It is a primary objective for a belt press to fabricate press material without defects caused by bar marks. One solution to this problem would be to use a single interconnected drive mechanism for both the upper and lower roller sets, by connecting the upper and lower chain drive axes with, for example, a timing chain. That technique, however, makes separation of the upper and lower presses difficult, which hinders maintenance and overall press versatility.

SUMMARY OF THE INVENTION

These objects and others which will become more apparent hereinafter are attained in accordance with the invention in a belt-type press for making particleboard, fiberboard, copper clad laminates for printed circuit boards, pressedboard, laminates, and the like comprising endless upper and lower press belts, preferably steel press belts, circulated over upper and lower belt guide rollers. These upper and lower press belts are positioned to form a pressing gap between the upper and lower press belts in a pressing region, and the press framework has upper and lower platens as well as upper and lower roller chain drive mechanisms.

A plurality of rolling rods spaced apart from each other are fed into the pressing region between each of the platens and its corresponding press belt. The rollers are guided with a chain and guide circulating mechanism, wherein each roller is fastened at its ends between first and second chains, and each chain set is guided over at least one sprocket driven by a chain drive motor. Guide rails control the movement of the roller drive chains.

At the press gap entrance, the rollers are continuously circulating between the platens and press belts. The platens, press belts and rollers are commonly made of steel. The chains used to drive the rollers are known as roller drive chains. The roller drive chains are driven by chain drive sprockets, which are connected to the ends of chain drive axles. The chain drive axles are connected to chain drive motors, which drive the entire chain drive mechanism. Both the upper and lower presses have a set of rollers and chains, and both the upper and lower presses have their own chain drive motors.

According to the present invention, the relative positions of the upper and lower rollers are monitored and controlled.

As described above, the chain sets are driven by sprockets. Specifically, two sprockets are used for the upper and another two for the lower set of chains. The sprockets are each fastened at each end of an axle that is driven by a chain drive motor. These axles each rotate at a speed set by its respective chain drive motor (one for the upper press and another for the lower press). The sprockets drive roller chains in response to the chain drive motors being activated. Thus, in order to sense the position of the upper and lower roller sets, that is, to ascertain when rollers reach the press gap entrance at any given instant in time, only the angular positions of the sprockets nearest the press gap entrance need be known. Because the rollers are mechanically coupled to the chains, and the chains are disposed against sprockets, the angular position of the drive sprockets is indicative of the position of the rollers at all times.

According to a preferred embodiment of the present invention, an apertured disk is fastened to the drive axle located at the press gap entrance and chain drive sprocket. The apertured disks revolve along with the sprockets. One apertured disk is fastened to the upper drive axle located at the press gap entrance, while another is fastened to the lower drive axle. The apertures of the upper and lower disks are arranged such that an optical sensor keeps track of the movement of the upper and lower roller chains by sensing the rotation of the apertured disks. These apertured disks are also known as chopper disks, since the apertured disks are rotated between an optical emitter and sensor, and the disks chop the light beams. A programmable computer (or programmable logic controller ("PLC")) is used to monitor the positions of the upper and lower chains, and in response to sensing a shift in their relative positions, sends impulses to the chain drive motors to adjust their respective speeds, or at least the speed of one, so that the movement of the upper and lower roller chains can be kept in sync. In this manner, the positions of the upper and lower roller chains are monitored and controlled so that they are synchronous, and therefore, the positions of the upper and lower rollers are never allowed to overlap, including at the point where they reach the press gap entrance.

DETAILED DESCRIPTION OF THE PREFERRED EMBODIMENT

Figure 1:
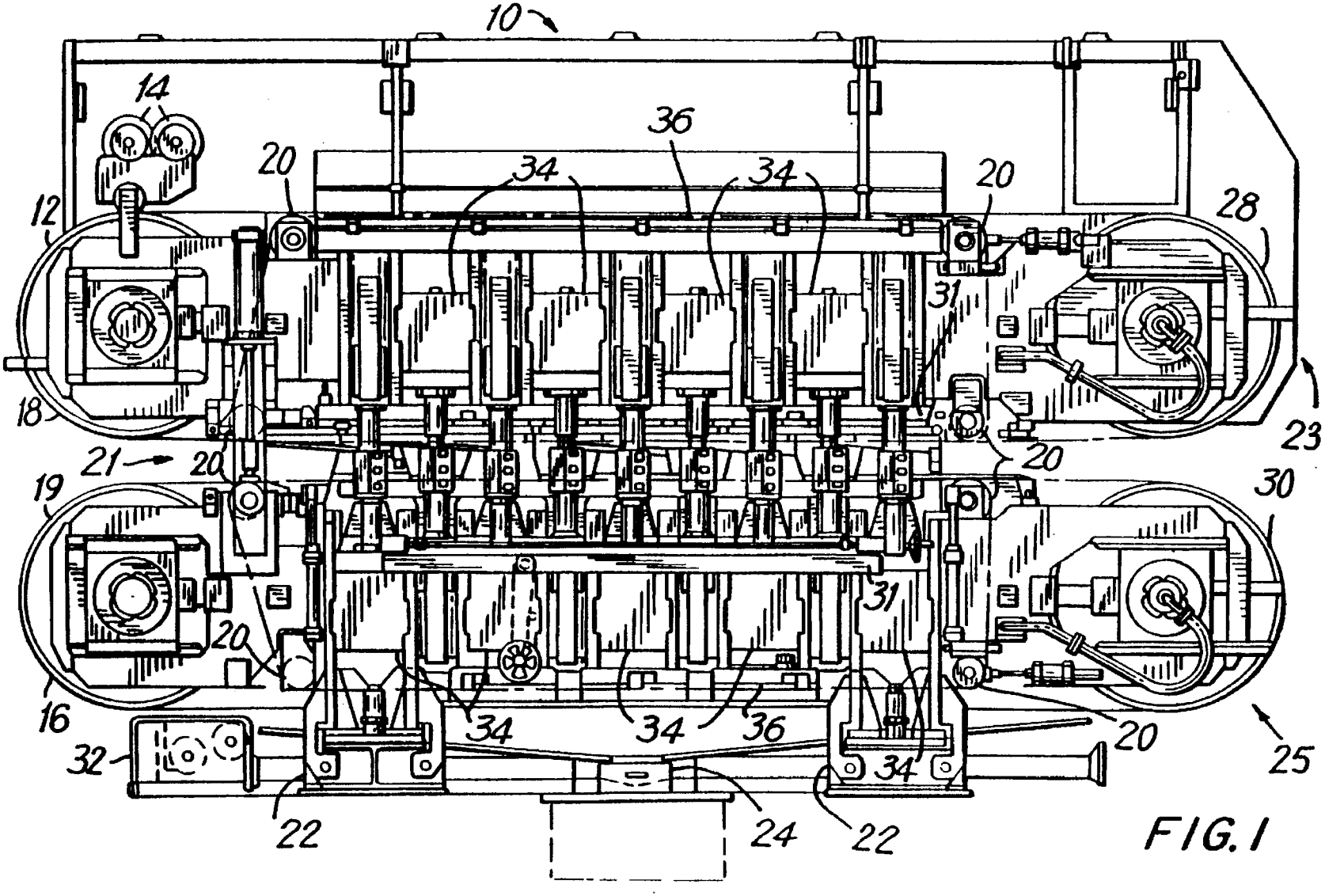
FIG. 1 is a side view of a continuous belt press system.

FIG. 1 is a side view of a continuous belt press system 10. Top exit drum 28 is driven counterclockwise and bottom exit drum 30 is driven clockwise, so that press belts 18 and 19 are driven through the press gap 21. In turn, top entry drum 12 and bottom entry drum 16 rotate along with press belts 18 and 19. Typically, only exit drums 28 and 30 are actually motor driven, while entry drums 12 and 16 are in turn driven by their corresponding belts. Importantly, the upper press assembly 23 and the lower press assembly 25 have press belts 18 and 19 respectively that are independently driven. In this manner, the upper and lower press assemblies can be separated, that is, for example, the upper press assembly 23 can be raised without being confined by any mechanical connections to the lower press assembly 25.

The upper press assembly 23 is raised away from the lower press assembly 25 by the activation of belt press open/close cylinder assemblies 34, which are located out of the way, to the sides of press belts 18 and 19. In the manufacture of laminates, for example, the fabrication of copper clad laminates for printed circuit boards, press belts 18 and 19 compress material (press material) which is inserted into the press gap 21. Belt wiper units 14 and 32 are used to clean off the press belts, e.g., to remove dust and dirt that can interfere with the manufacturing process from the belts. The wiper units may incorporate the use of fabric to wipe off the belts. Excess fluids (e.g., lubricants) are collected below the belt press system 10 in fluid pan 24.

The upper belt system 23 is connected to the lower belt system 25 by a series of hinges and support structures, well known in the art. The lower belt system 25 is supported by support fixtures 22. The upper and lower press belt systems 23 and 25 nearly meet, so that a press gap 21 is formed between upper press belt 18 and lower press belt 19. Friction is applied to press materials entering the press gap 21 by the upper press belt 18 supported by upper platen 31, and by the lower press belt 19 supported by lower platen 31. Both of these platens 31, often made of steel, can be heated as desired. A series of rollers 62 (also often made of steel and shown at FIG. 3) driven by a chain 48 are sandwiched between the upper and lower press belts and their respective platens. These rollers 62 support the belts and facilitate their movement along the length of the continuous belt press 10, and also serve to transfer heat from the platens 31 to the belts 18 and 19. The belts, rollers and platens can be composed of any material desired, but often, they are all made of steel. In this manner, the rollers 62 transfer heat from the platens 31 to the belts 18 and 19. When belts 18 and 19 are also made of steel or other thermally conductive materials, the heat of platen 31 is transferred to the press material being inserted into the press gap 21.

Chain guide 36 is used to guide the upper roller timing chain 48 so that the chain does not become entangles in various moving parts. A corresponding chain guide (not shown), is also used to guide the lower roller timing chain.

Figure 2:
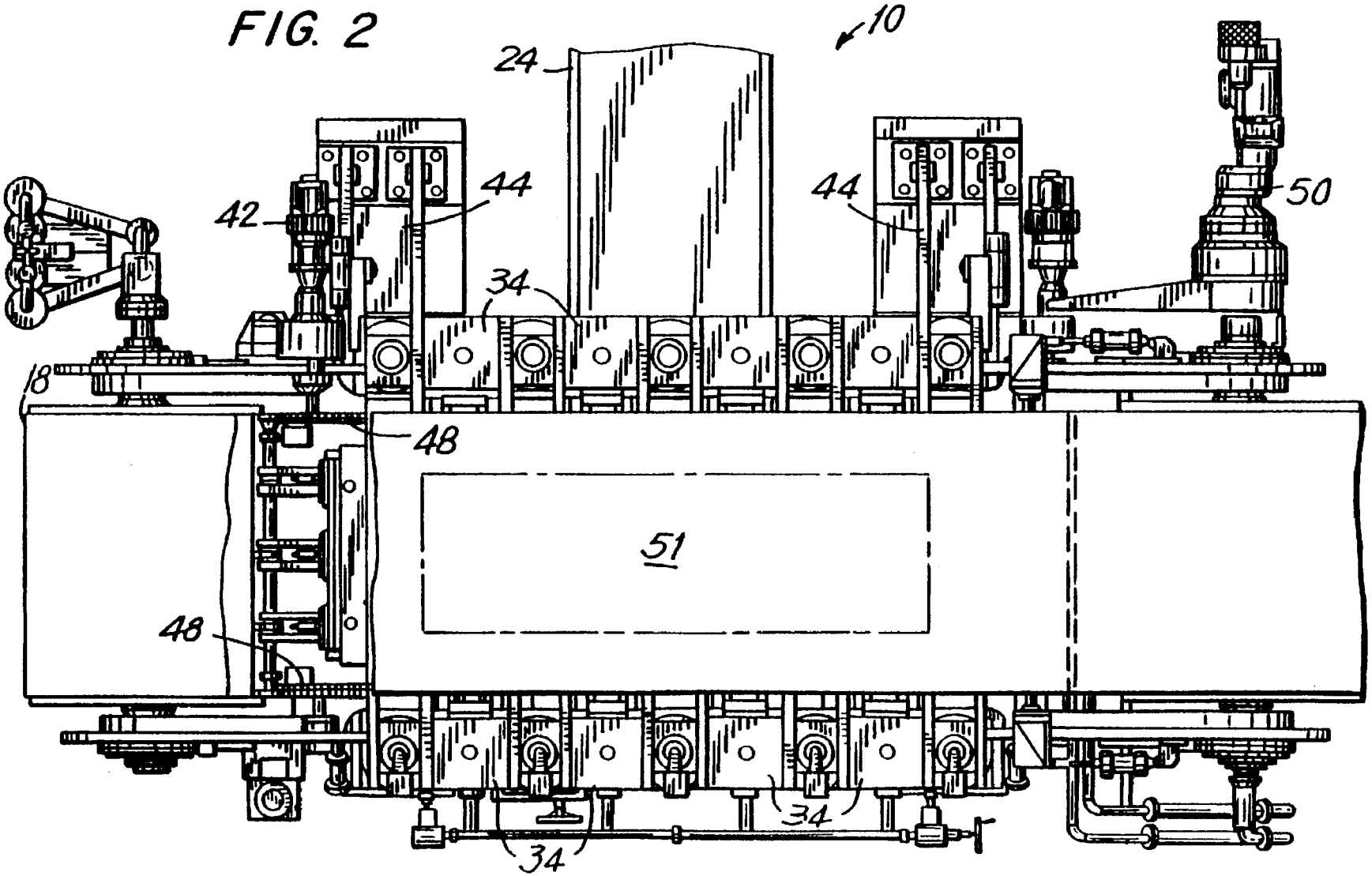
FIG. 2 is a top view of a continuous belt press system.

FIG. 2 is a top view of a continuous belt press system 10, which shows in greater detail the chain drive system used for the upper press belt system 23. Similar or identical apparatus is also associated with the lower press belt system 25. Mechanism 42 drives the chain drive axis 20, which drives sprockets which mate with roller timing chain 48. Thus, two roller timing chains 48 are associated with both the upper and lower press belt system. The top press belt system 23 is supported by top belt press supports 44. Belt press open/close cylinders 34 are activated to raise the upper press belt system 23. Press belt 18 is driven by belt drive mechanism 50. The roller timing chains 48 (two used for the upper press belt system 23 and two used for the lower press belt system 25) are connected to both ends of a series of rollers 62, and cause these rollers 62 to move along with and support the press belts 18 and 19.

Figure 3:
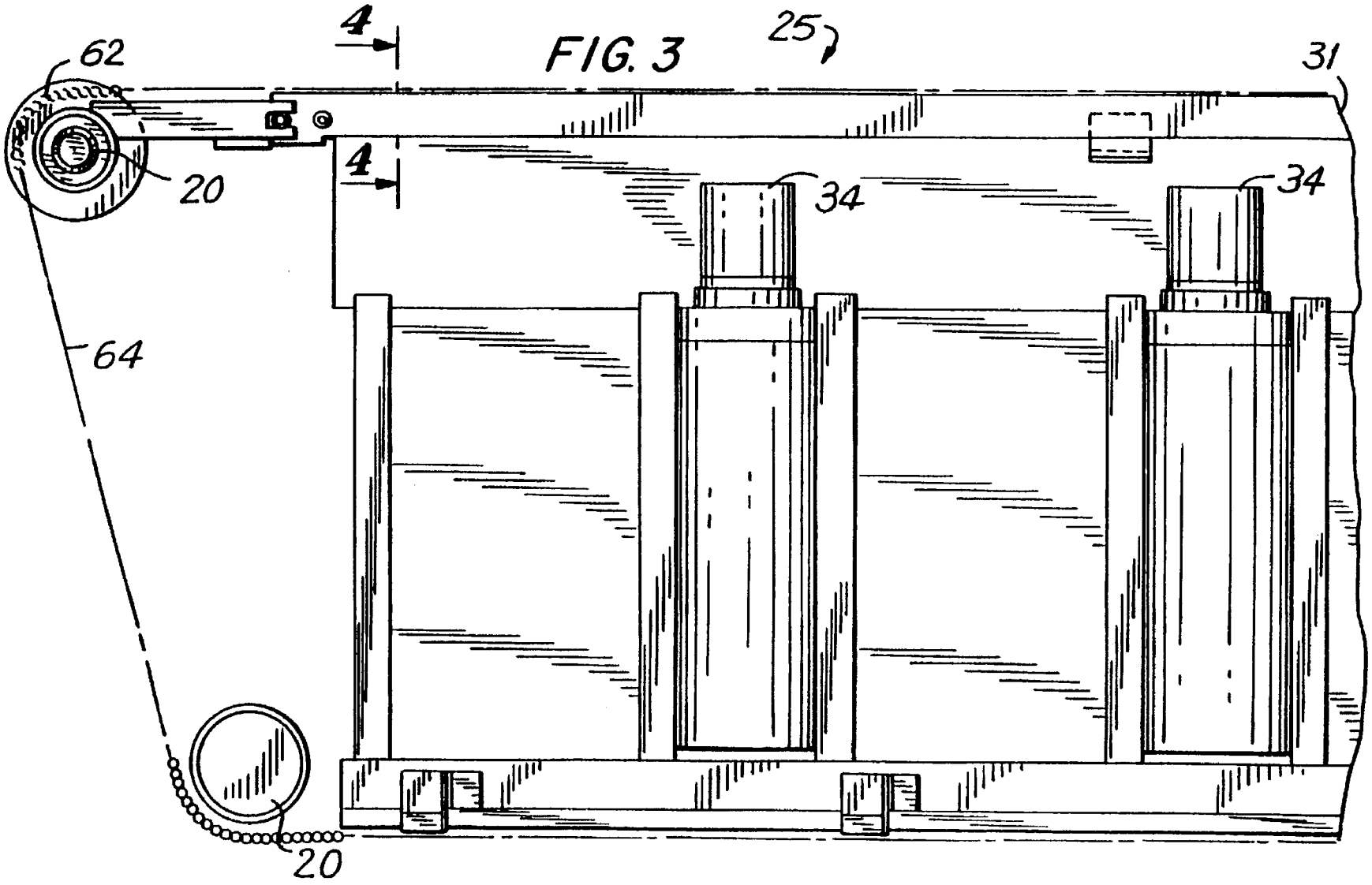
FIG. 3 is a diagram of the roller drive system of the bottom half of a continuous belt press.
Figure 4:
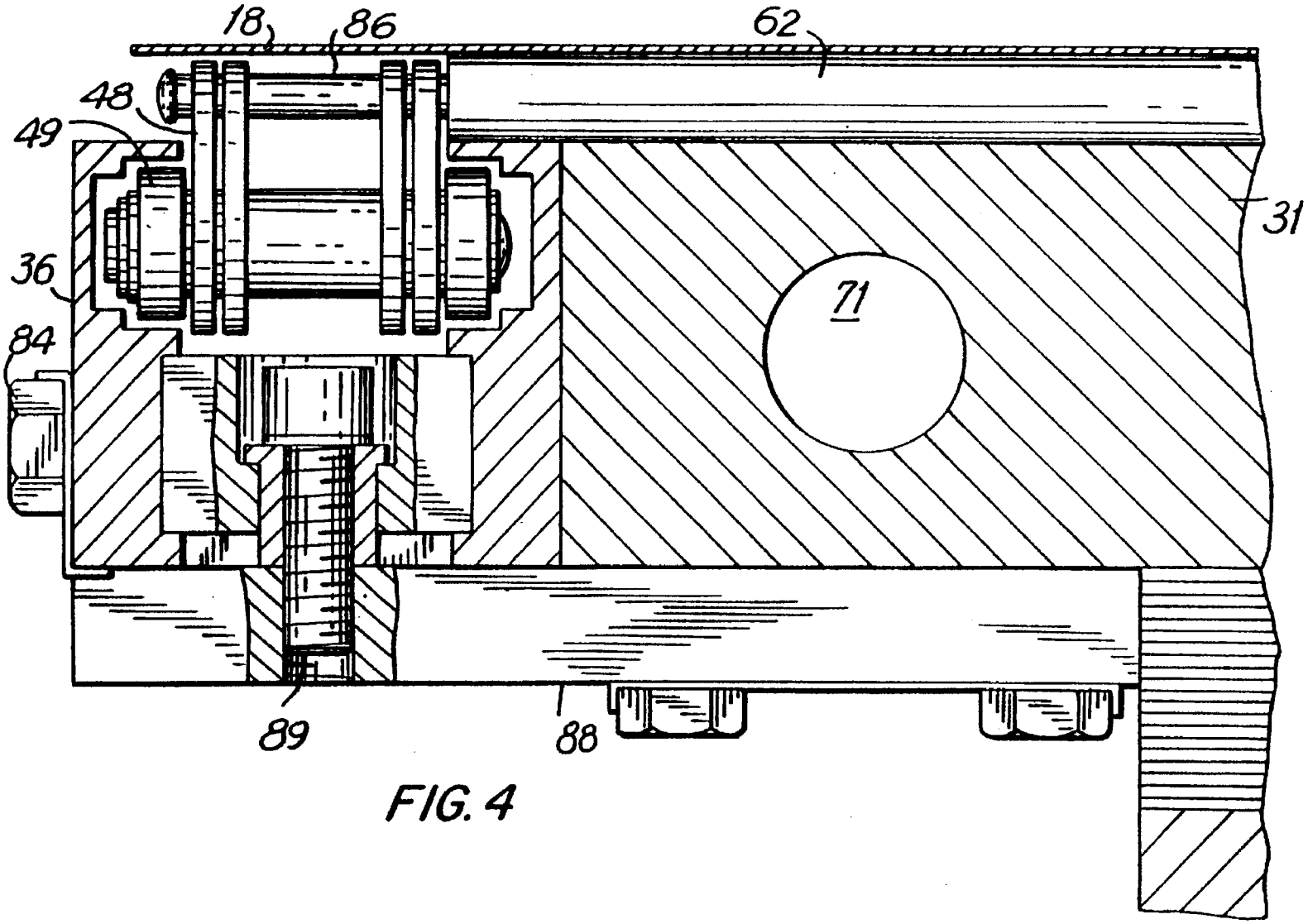
FIG. 4 is a cross-sectional view 4—4 taken from FIG. 3.

FIG. 3 is a diagram of the roller drive system of the lower press belt system 25. Each of rollers 62 is fastened at each end to a separate roller timing chain 48 (which follow pathway 64, and are shown at FIG. 4), where one timing chain 48 is located at each side of upper press 23, and one timing chain 48 is located at each side of lower press 25. In all, four timing chains 48 are used to construct a belt press 10. Chain drive sprockets 20 (shown at FIG. 1) rotate about their respective roller chain axes of rotation 20, and drive the roller timing chains 48 along the pathway 64. In turn, the rollers 62 are driven by the chains 48. The rollers provide support and transfer heat to the press belts 18 and 19. The rollers 62 allow the belts to glide through the pressing region 51 (between belts 18 and 19) of the belt press system 10, even though a high degree of friction can be applied when press material enters the pressing region 51 via the press gap entrance 21. Since platens 31 can be heated, and rollers 62 can transfer heat to the press belts 18 and 19, and ultimately to the press material, the rollers 62 ensure that an equal amount of force is applied to the press material throughout the length of the press region 51.

FIG. 4 is a cross-sectional view 4—4 taken from FIG. 3, which shows a platen 31 and roller 62 in greater detail. Platen 31 can be heated or cooled by circulating fluid of various temperatures through platen viaduct 71. Roller 62 is fastened to two roller timing chains 48, one on each side of the press belt system 10, by roller connecting pins 86. Connecting pins 86 are used to fasten each roller 62 to each link in the roller timing chain 48. Each of the links of the roller timing chain 48 also have bearings 49 associated with them. Bearings 49 travel, that is, roll through, a mating slot in the roller timing chain guide 36. Chain guide bolt 84 and mounting bolt 89 are used to fasten the chain guide 36 to the chain guide support bracket 88. As shown in FIG. 4, press belt 18 is supported by roller 62, which translates heat from the platen 31 to the press belt 18, while also facilitating the movement of the press belt 18 through the pressing region 51 of the upper belt press system 23, even under high loading conditions.

Figure 5:
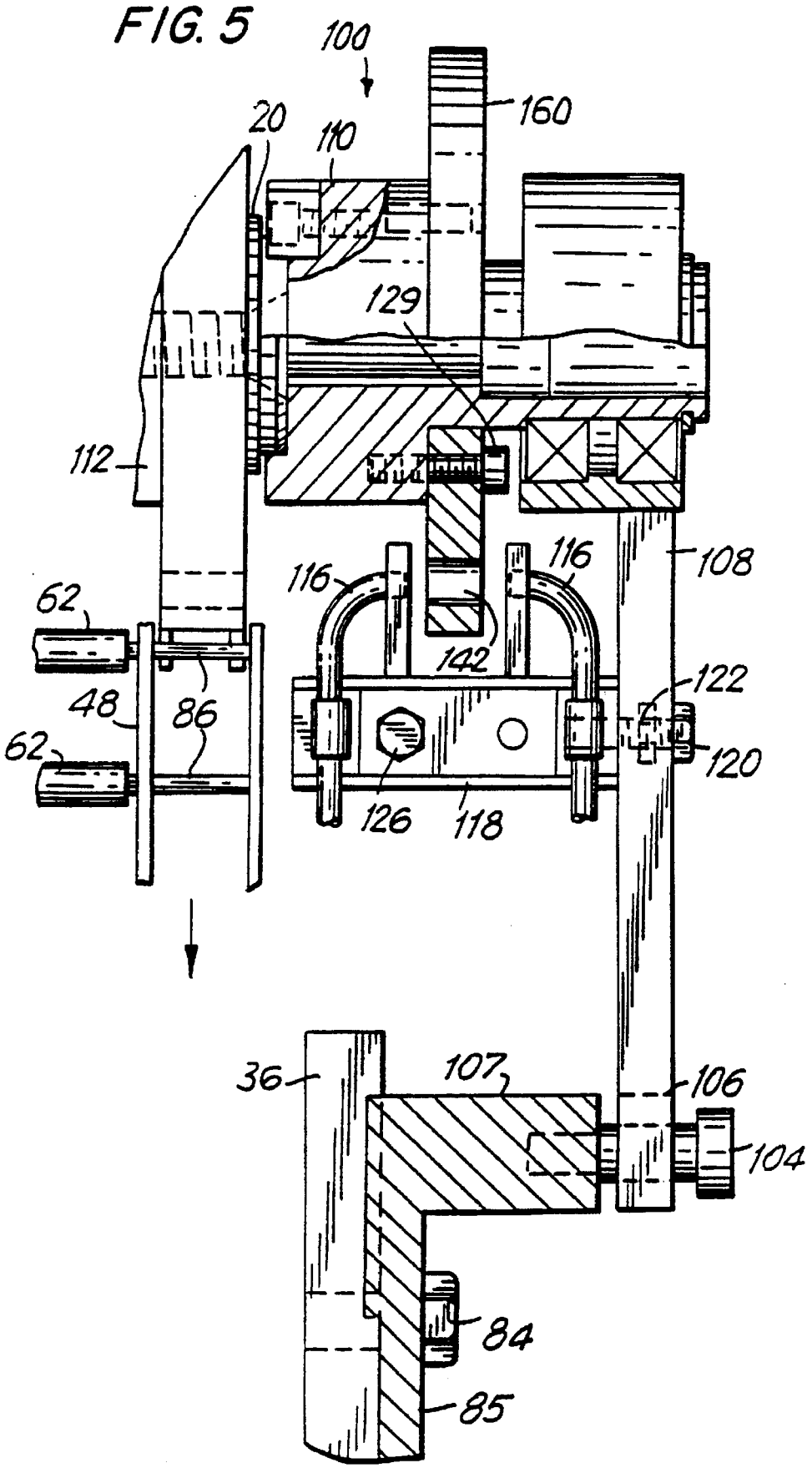
FIG. 5 is a top view of the position indicator mounting structure used for the lower half of a continuous belt press system, shown with the apertured disk.
Figure 7:
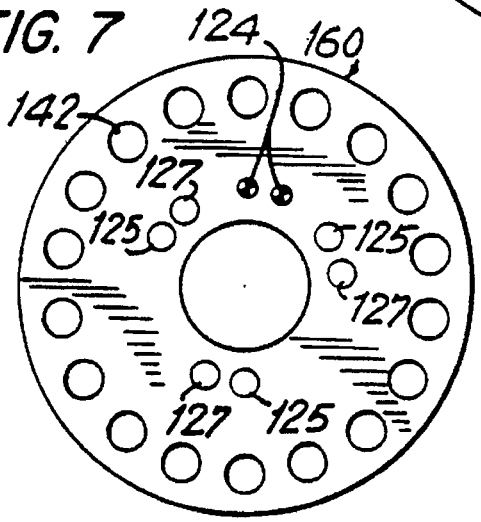
FIG. 7 is a detailed view of the apertured disk or chopper disk.

FIG. 5 is a top view of the roller timing chain position indicator system 100. The roller chain axis of rotation (an axle) 20 is connected to an apertured disk 160, also called a chopper disk. The apertured disk 160 is fastened to the disk or chopper hub 110, which rotates along with axle 20, by chopper disk bolts 129, as shown in FIG. 5. Chopper disk bolts 129 are inserted through sets of holes (either set 125 or set 127, as shown in FIG. 7), and one dowel pin 124 is inserted to permanently calibrate the angular position of the chopper disk 160 with respect to the chopper hub 110. Two roller pins 86 (and corresponding rollers 62) are inserted into one end of each link of timing chain 48. The opposite end of each link of timing chain 48 is disposed across the teeth of drive sprockets 20. In this manner, chopper 160 rotates in sync with the movement of the timing chain 48. One position indicator system 100 is associated with upper press belt system 23, and a second position indicator system 100 is associated with the lower press belt system 25.

The chopper hub 110 and chopper disk 160 together rotate synchronously with the chain drive axes of rotation 20. Sensor arm 108 is connected to the chain guide 36 by sensor arm bolt 104, sensor arm mount 107, guide mounting bolt 84 and arm lock 85. Sensor arm bolt 104 is fastened to the sensor arm 108 through the sensor arm adjustment slot 106. Adjustment slot 106 permits the sensor arm to be moved to a position where the chopper hub 110 can be interconnected to the axis of rotation (axle) 20.

Figure 6:
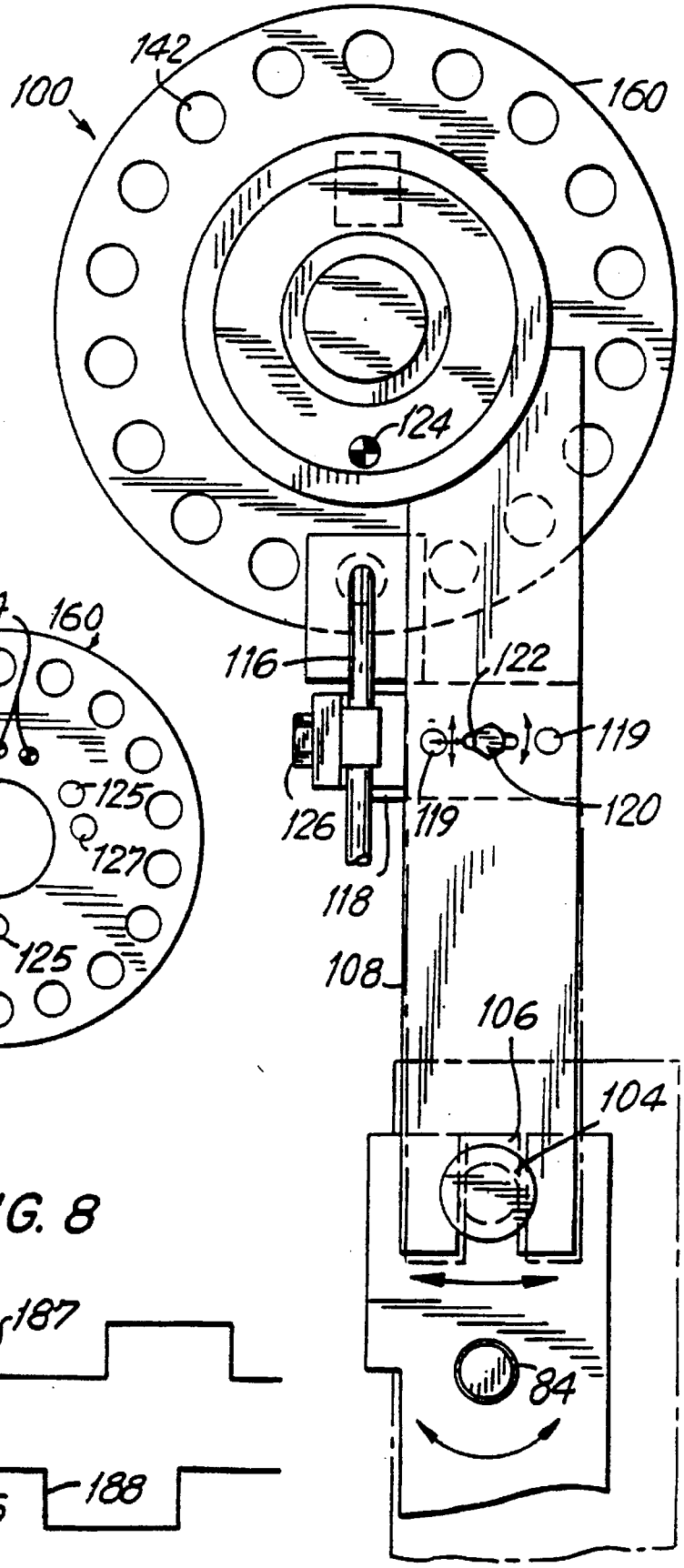
FIG. 6 is a side view of the position indicator system, shown with the apertured disk or chopper disk.

Chopper disk 160, shown in greater detail in FIG. 6, rotates between a pair of fiber optic sensors 116. Fiber optic sensors 116 are used to sense the angular position of the chopper disk 160. In actuality, one of the sensors 116 is an emitter, while the other sensor is the actual sensor that senses the position chopper 160. That is, the rotation of chopper 160, with its apertures 142 interposed between sensors 116, allows the angular position of the chopper 160 to be determined at all times. Sensors 116 are part of a fiber optic system, which is mounted to the fiber optic sensor mounting plate 118. Mounting plate 118 is attached to the sensor arm 108 by sensor plate bolt 120. Sensor mounting plate bolt 120 is mounted through the sensor mounting plate slotted adjustment 122. Slotted adjustment 122 is used so that the apertures 142 can be aligned with the sensors 116. Because the position of the sensors is so critical, mounting pins 119 (shown at FIG. 6) are used to secure the position of the plate 118 after the sensors 116 have been calibrated with respect to the apertures 142.

FIG. 6 is a side view of position indicator system 100, shown with chopper disk 160 and its apertures 142. Sensor mounting plate bolt 120 can be adjusted within adjustment hole 122. Sensor mounting plate 118 is adjusted to obtain equal fiber optic light signals. That is, the light impulses of the optical fiber should optimally be centered within the circular apertures 142, so that the "ON" and "OFF" signal durations are equal. This is achieved by moving plate 118 until sensors 116 and apertures 142 are precisely aligned within the confines of bolt 120 and bolt hole 122. Once the precise optimum location of plate 118 is determined, mounting pins 119 (two pins 119 for the top press 23 and two for the bottom press 25) are installed to lock in the relative position between the sensors 116 and apertures 142. By using permanent mounting pins 119, provision is made for the subsequent disassembly of the entire apparatus for servicing and then, returning the press into service without the need to re-calibrate the sensors 116 with respect to the apertures 142, since pins 119 fix plate 118 to arm 108. Sensor bolt 104 and slot 106 are used to allow for angular rotation of plate 118 to adjust the relative timing between the top and bottom press (23 and 25 respectively) chains 48, so that angular synchronization is achieved. In effect, the arm 108 can be moved to position the sensors 116 over one of two consecutive apertures 142 (i.e., retard or advance), so that the aperture 142 being scanned by an upper sensor 116 is the same as that being scanned by a lower sensor 116. Arm lock 85 rotates about bolt 84 to cause arm 108 to swing and pivot about the bolt 104, which loosely cooperates with oversized hole 106. That is, bolt 104 does not compress arm 108 against arm lock 85; rather, bolt 84 tightly fastens arm lock 85 to the chain guide 36.

FIG. 7 is a detailed view of the chopper disk 160, shown with apertures 142. Chopper disk 160 is bolted to chopper hub 110 by using a total of three mounting bolts 129—mounted in either hole set 125 or 127. Mounting bolt holes 125 or 127 are offset by 30°, which permits the angular position of chopper disk 160 to be coarsely adjusted. Locator holes 124 (shown in FIG. 7, and corresponding dowel pins 124 (shown in FIG. 6) are used to set the final desired position of the plate 160 with respect to the chopper hub 110. In this manner, the plate 160 can be permanently calibrated with respect to the overall sensor system.

The ability to exactly position the apertures 142 directly over the sensors 116 is critical. Sensors 116 sense the periodic flows ("ON") and blockages ("OFF") of light through the chopper disk 160. Ideally, a center chord (along the diameter) of the light beam emitted from light sensors 116 travels directly over a center chord of the apertures 142. If, however, the sensors 116 are misaligned, the centers of sensors 116 will pass over a chord of apertures 142, where such chord length is less than the diameter of the apertures 142. In this event, the ON/OFF signals transmitted by sensors 116 will be distorted. Specifically, the ON and OFF durations will not be equal and will be skewed in proportion to the difference between the chord length of travel across the apertures and the diameter of the apertures. This will lead to erratic results. Generally, the diameter of sensors 116 is small in comparison to that of the apertures 142. The distance between consecutive apertures 142 on chopper plate 160 is equal to the diameter of the apertures. In this manner, a 50% duty-cycle is output by the sensors 116. That is, as the sensor 116 traverses the apertures 142, the sensors ideally traverse the center chord (or diameter) of the apertures 142 (a distance d), and then traverse the a portion of plate 160 without an aperture, also a distance equal to d. In turn, the sensors 116 scan all apertured and non-apertured sectors of the plate 160, and output a 50% duty-cycle waveform. Finally, the number of apertures 142 in plate 160 is proportional to the number of teeth in sprockets 20, so that sprockets 20 angular position can at all times be ascertained by sensing the plates 160.

Figure 8:
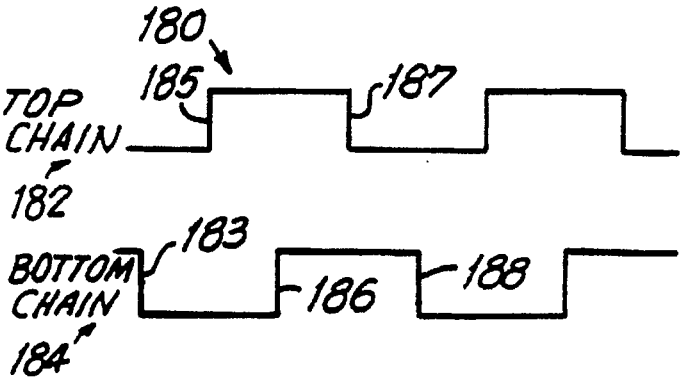
FIG. 8 is a timing diagram of the positions of the upper and lower roller chains.

In FIG. 8, a timing diagram 180 of the upper and lower position indicator systems 100 is shown. As shown, the duty-cycles of both the upper (182) and lower (184) sensor 116 outputs is at 50%, which is ideal. If, however, the diameters of the sensors 116 and apertures 142 do not precisely align, other duty-cycles will result, and the positions of the chopper disks 160 cannot be accurately read. Distortion is created. As shown in FIG. 8, the rising edges of the top chain waveform 182 correspond to the middle of the OFF period (or lower level) for the lower chain waveform 184. That is, a 90° phase shift is present, indicating that the upper and lower chopper plates are alternating. In sequence: at 183, the lower chopper has just closed; at 185, the upper chopper has just opened; at 186, the lower chopper has just opened; at 187, the upper chopper has just closed; at 188, the lower chopper has just closed. This sequence of events is repeated continuously, and as shown by diagram 180, the positions of upper and lower chopper plates 160 are precisely staggered. This condition is ideal, because it is indicative of the fact that the upper and lower roller chains 48 and their sprockets 20 are also staggered, or out of phase. In turn, the positions of the upper and lower rollers 62 are also necessarily staggered. This is a principal object of the present invention—to keep the upper and lower rollers 62 from ever overlapping, particularly at the press gap entrance 21, where press material defects or damage can result. Specifically, waveforms 182 and 184 must never be allowed to overlap. If they do, such would indicate that the upper and lower rollers 62 have aligned, one on top of the other. If that occurred, then the press belts 18 and 19 would both have rigid support members (rollers 62) behind them at identical points at the press gap entrance 21. When press products such as laminates are being fabricated by the continuous belt press 10, defects can result if the products are "pinched" at the press gap opening 21. Such "pinching" occurs when rollers 62 are collocated behind their respective press belts 18 and 19. When this occurs, a localized high loading upon the belts 18 and 19 are impinged against the press product, and so called bar marks or other defects can result.

Figure 9:
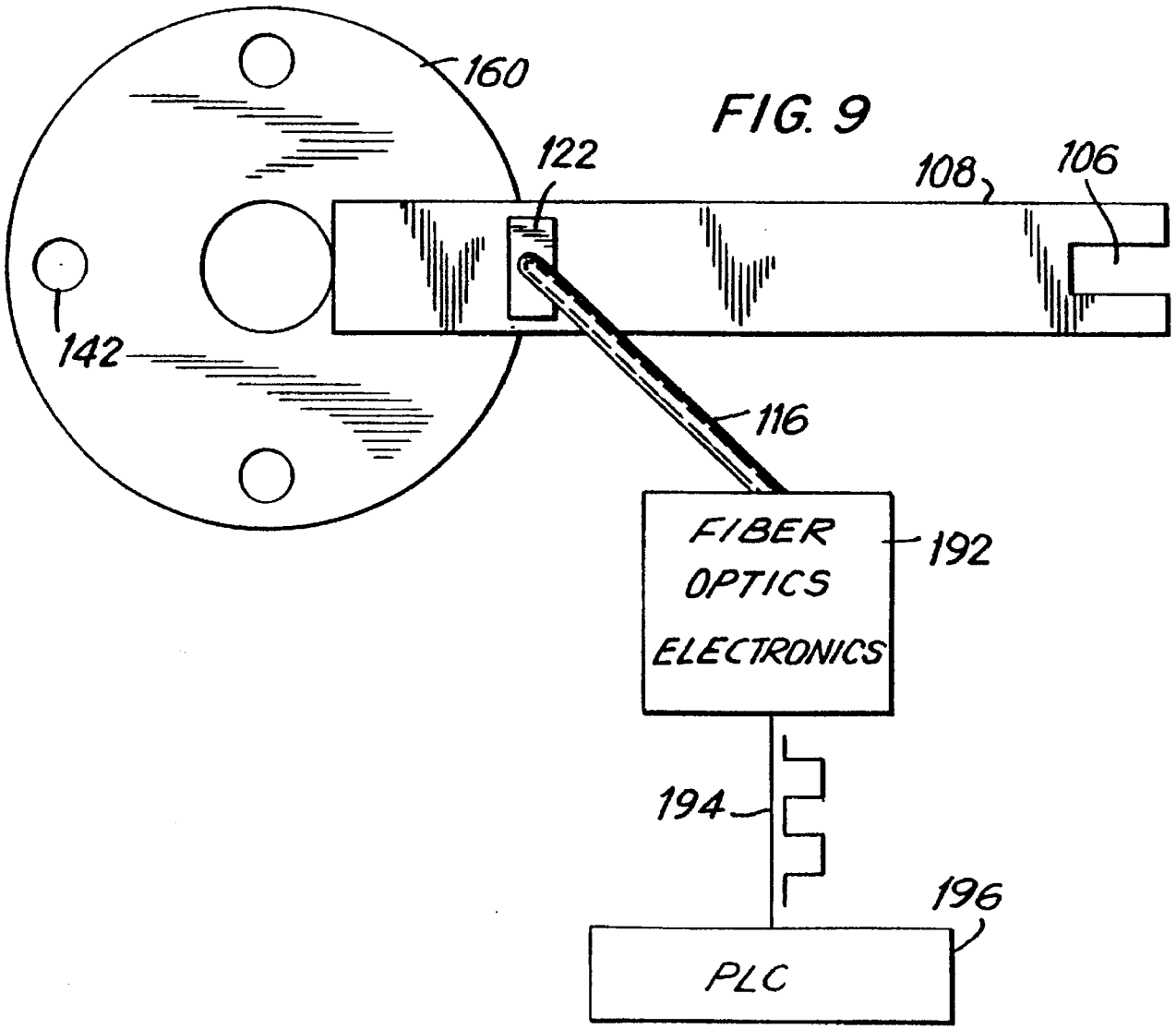
FIG. 9 is a block diagram of the position indicator system and its calibration mechanisms.
Figure 10:
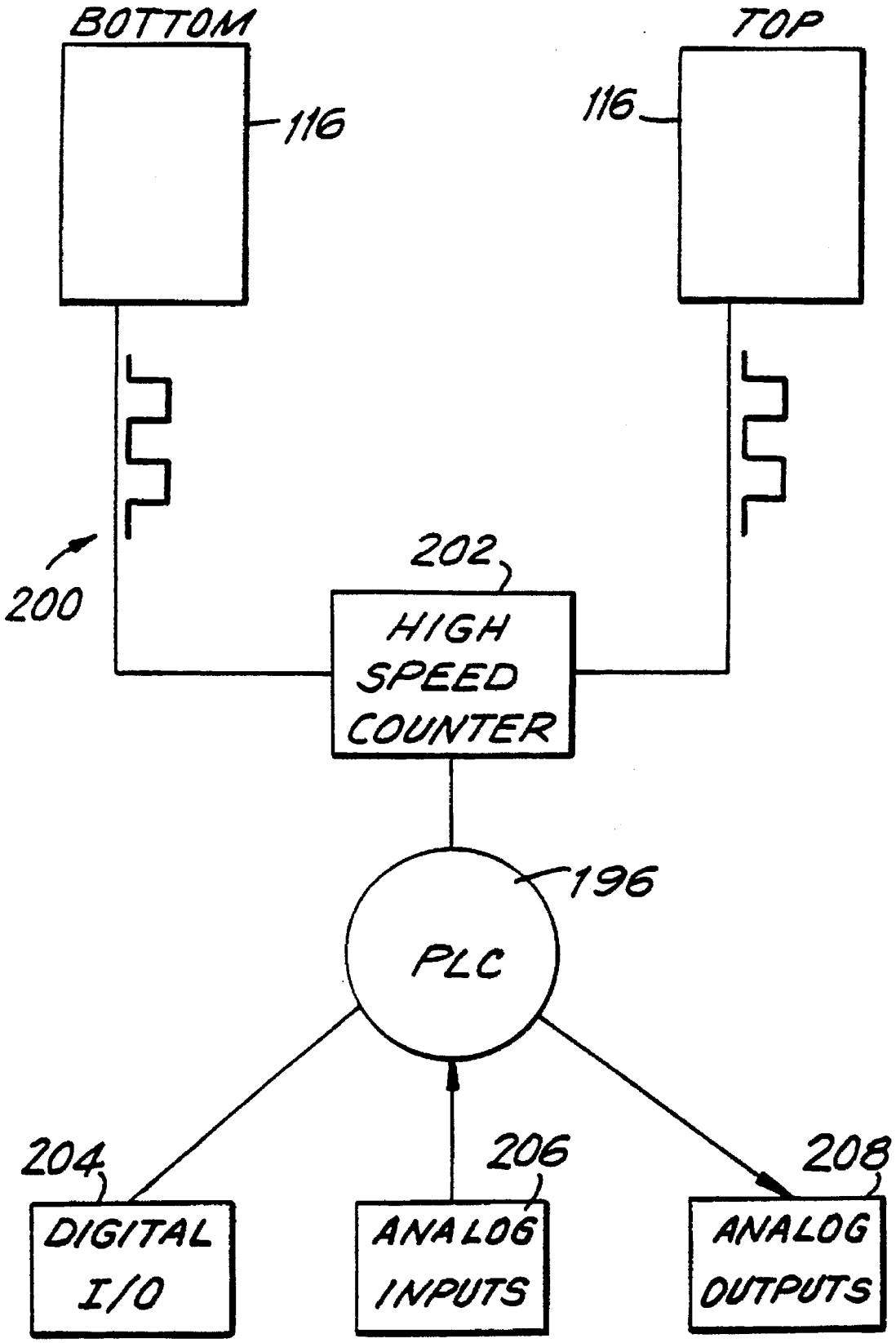
FIG. 10 is a block diagram of the electronic control system used to monitor and control roller position.

It is a principal object of the present invention to provide a system whereby rollers 62 are evenly spaced apart such that at any given instant in time, only one roller 62—either a top or bottom roller—will be aligned with the press gap entrance 21 at a time. In this manner, press product defects are prevented. FIG. 9 is a block diagram of the position indicator system 100 and its calibration mechanisms, shown with chopper disk 160, certain apertures 142, fiber optic electronics 192 and programmable logic controller ("PLC") 196. Waveforms 182 and 184 are transmitted along line 194 (that is, waveform 182 for the top position indicator system 100 and waveform 184 for the bottom position indicator 100). Fiber optic electronics 192 are connected to sensors 116, which sense the apertures 142. Sensor arm 108 is shown with its sensor mounting adjustment 122 and its sensor arm hole adjustment 106. Adjustment 122 is used to position the sensor 116 over the apertures 142, while adjustment 106 allows sensor arm bolt 104 to be used to coarsely set the position of the entire position indicator assembly 100 with respect to the belt presses 23 and 25. FIG. 10 is a block diagram of the electronic control system 200 used to monitor and control the positions of upper and lower rollers 62. One sensor unit 116 is associated with each belt press (23 and 25), and a high speed counter unit 202 receives the sensor output. The high speed counter 202 outputs its signal (indicative of the angular position of the chopper disks 160) to the programmable logic controller 196. A digital input/output interface 204 to the PLC 196 is used to control various aspects of the optical fiber sensors 116, and other digital control circuitry, to ensure that the PLC is programmed in a manner to achieve the functionality of the present invention. Analog inputs 206 are supplied from the press belt system 10, which are merely indicators of the speed of the upper and lower belts 18 and 19. The signals received from the belt press 10 indicative of press speed can be supplied, for example, by a simple low voltage generator connected to axle 20. Analog outputs 208 are bias signals used to control (or alter) the speeds of the belts 18 and 19. For most applications, it is only necessary that the speed of one belt be controlled, since it is the relative position between the upper and lower presses that is critical. In this manner, for example, the speed of belt 19 can be adjusted, while the speed of the upper belt 18 is maintained. Because the PLC 196 transmits a bias signal 208 to one chain drive mechanism 42 or the other, and because the PLC receives belt speed feedback along input 206, PLC 196 is capable of adjusting the speeds of the chain drives (and in turn, the roller timing chains 48) so that the rollers 62 are always staggered as taught by the present invention. Counter 202 continuously supplies PLC 196 with a signal indicative of the roller 62 positions, so PLC 196 can react by changing the speeds of the roller chains 48 via output 208. PLC 196 adjusts the roller chain 48 speed until an appropriate degree of feedback is received along input 206. Then, the PLC will only react further if counter 202 is indicating that an overlap condition is approaching. Thus, PLC 196 can control the positions of the upper and lower rollers 62.

Figure 11:
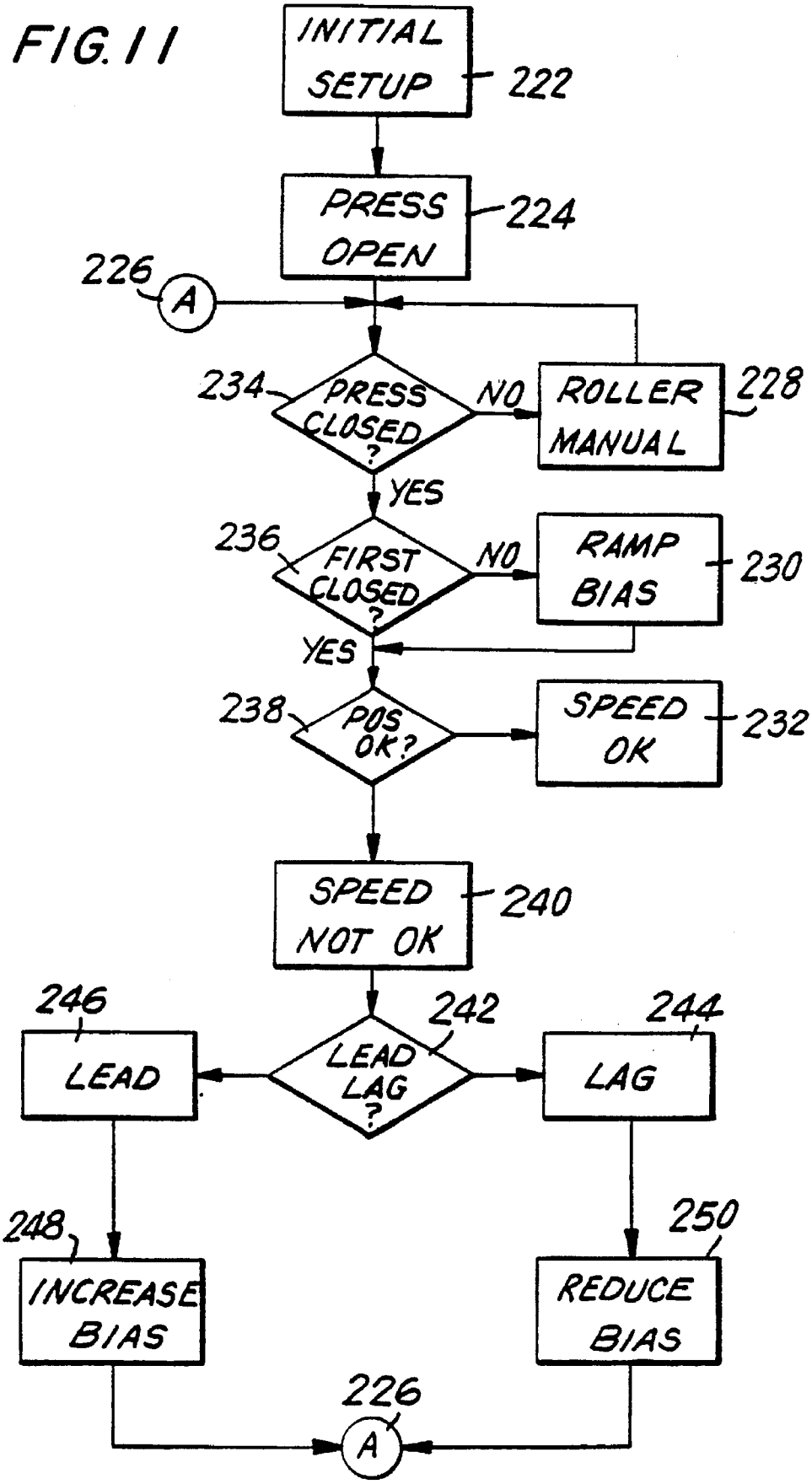
FIG. 11 is a flow diagram of the control system set forth in FIG. 9.

FIG. 11 is a flow diagram of the control system 200, including an initial set-up step 222. Initial setup step 222 must be performed before the system is activated. The adjustments along sensor arm 108 are provided for that purpose. Adjustment 106 is adjusted so that the chopper hub 110 is aligned with the axis of rotation 20. First, sensor bolt 120 within hole 122 is adjusted so that sensors 116 are aligned with the apertures 142. Sensor 116, which has a diameter substantially less than that of the apertures 142 of plate 160, is aligned to pass directly over the centers of apertures 142. By moving bracket 118 (at FIG. 6), alignment of sensors 116 is accomplished so that a 50% duty-cycle is achieved. When a 50% duty-cycle is achieved, bracket 118 is locked into position with pins 119. This is performed only once for the initial calibration step. Then, sensor arms 108 (both on the top and bottom presses (23 and 25 respectively), can be adjusted so that the upper and lower sensors 116 and their respective sets of apertures 142 are in phase. That is, when an aperture 142 is passing between an upper sensor 116, so is a lower aperture passing between its corresponding sensor. Then, the apertures 142 are synchronized with the rollers 62. By adjusting the upper and lower sensor arms 108 (by bolts 104 disposed within holes 106), and locking them into place by arm locks 85, the upper and lower sensor systems are calibrated with each other, so that the relative positions between the upper and lower rollers 62 can be controlled, optimally, so that they are exactly staggered, alternating (between top and bottom) on their approach to the press gap entrance 21.

The chopper 160 may need to be skewed by selecting the alternate set of holes between sets 125 and 127. The chopper 160, which is used to "chop" the light used by sensor 116, is then permanently calibrated or keyed by dowel pins 124. In this manner, coarse and fine adjustments are provided so that the position indicator system 100 can be calibrated. Next, the upper press 23 and lower press 25 are set into motion at step 224 and the waveforms 182 and 184 are checked for a 50% duty-cycle. The presses 23 and 25 are permitted to run freely during this step, without any loading. If the duty-cycles are not at 50%, then the slotted adjustments must be made again, until both waveforms 182 and 184 are at 50% (50% ON and 50% OFF). The rollers 62 may also be moved manually (step 228) before the press 10 is closed (step 234). When the presses are first closed (step 236), an initial bias signal 230 will be applied. If the press 10 has not been just closed, the relative positions of the top and bottom rollers will be checked at step 238. If the speed is OK (232), no bias signal will be applied. However, if the waveforms 182 and 184 do not overlap as shown in FIG. 8, then a lead 246 or lag 244 situation will be detected, and the bias will be either reduced 250 or increased 248, which results in the appropriate stimulus output at 208. This insures that the upper and lower rollers 62 are exactly staggered as they reach the press gap entrance 21. This flow is then repeated back to "A" (226). The bias signals (determined at 248 and 250) will both increase or decrease the speed of, for example, the bottom belt 19 and its rollers 62. In this manner, the speed of the bottom rollers 62 can be adjusted so that the perfectly alternating or staggered roller pattern (represented by FIG. 8) can be sustained.

It is further contemplated that after having read the preceding disclosure, other alterations and modifications of the present invention will become apparent to those skilled in the art. It is intended that the following claims be interpreted to cover all such obvious alterations and modifications.

We claim:

1. A roller position controller for use in a continuous belt press having a plurality of rollers mounted upon a chain driven by a sprocket turned by a motor, said controller comprising:

an apertured disk mounted upon and synchronously rotated with said sprocket;

sensing means disposed about said apertured disk for sensing the angular position of apertures of said apertured disk; and controlling means attached to said motor for adjusting the speed of said motor in response to said sensing means.

2. A controller according to claim 1 wherein said sensing means is an optical sensor having emitter and sensor means.

3. A controller according to claim 1 wherein said controlling means is a programmable computer.

4. A controller according to claim 1 wherein said controlling means is a programmable logic controller.

5. A method for controlling the position of rollers associated with a belt forming a part of a continuous belt press, said method comprising the steps of:

mounting an apertured disk upon a belt press rotating axle wherein said rotating axle rotates synchronously with a roller chain of said belt press, and wherein apertures upon said apertured disk correspond to the position of said rollers fixed to said roller chain;

sensing the angular position of apertures upon said apertured disk; and adjusting the speed of said roller chain in response to the position of said rollers, wherein the position of said rollers is determined by sensing the angular position of said apertures.

6. A method for controlling the position of rollers associated with the continuous belt press according to claim 5, further comprising the step of:

calibrating the position of a sensor for sensing the presence of apertures upon said apertured disk so that said sensor produces either an "ON" or "OFF" signal corresponding to whether one of said rollers is positioned at an entrance of said continuous belt press.

7. A method for controlling the position of rollers associated with the continuous belt press according to claim 5, further comprising the step of:

calibrating the position of said apertured disk with respect to said belt press rotating axle so that a sensor for sensing the position of said apertured disk produces either an "ON" or "OFF" signal corresponding to whether one of said rollers is positioned at an entrance of said continuous belt press.

8. A roller position controller for use with a continuous belt press having a plurality of rollers disposed across each of two belts, wherein said two belts are aligned in close proximity one above the other to form a press gap entrance through which material to be pressed is inserted, comprising:

an upper platen;

an upper press belt, with upper rollers driven by an upper roller chain wherein said upper rollers are disposed between said upper platen and said upper press belt;

a lower platen;

a lower press belt, with lower rollers driven by a lower roller chain wherein said lower rollers are disposed between said lower platen and said lower press belt;

an upper apertured disk mounted to an upper rotating axle wherein said upper axis and said upper apertured disk rotate synchronously with the movement of said upper roller chain and where the apertures of said upper apertured disk are indicative of the positions of said upper rollers with respect to said press gap entrance;

a lower apertured disk mounted to a lower rotating axle wherein said lower axis and said lower apertured disk rotate synchronously with the movement of said lower roller chain and where the apertures of said lower apertured disk are indicative of the positions of said lower rollers with respect to said press gap entrance;

upper and lower sensor means, wherein said upper sensor senses the angular position of apertures of said upper apertured disk and wherein said lower sensor senses the angular position of the apertures of said lower apertured disk;

comparison means for comparing the angular positions of said upper and lower apertured disks in response to said upper and lower sensor means; and control means coupled to said comparison means for controlling the relative position between said upper rollers and said lower rollers.

9. A roller position controller according to claim 8 wherein said comparison means is a computer.

10. A roller position controller according to claim 8 wherein said upper or lower sensor means consists of an optical sensor having emitter means and means sensitive to said emitter means.

11. A roller position controller according to claim 10 wherein said optical sensor is positioned to sense a beam of light passing through said apertured disk.

12. A roller position controller according to claim 8 wherein the position of said upper or lower sensor means is adjustable with respect to the position of said apertured disk.

13. A roller position controller according to claim 8 wherein said apertured disk is rotatably fixable and is adjustable with respect to its associated axis of rotation.

14. A roller position controller according to claim 8 wherein said control means causes said upper and lower rollers to reach said press gap entrance at distinct times.

15. A roller position controller according to claim 8 wherein said upper or lower sensor means includes an electronic photo-sensitive device.

* * * * *